United States Patent [19]

Travis

[11] Patent Number: 4,805,857

[45] Date of Patent: Feb. 21, 1989

[54] SUPPORT RACK FOR PLASTIC BAGS

[76] Inventor: Elmer E. Travis, 10804 Central SE., Albuquerque, N. Mex. 87123

[21] Appl. No.: 194,623

[22] Filed: May 16, 1988

[51] Int. Cl.[4] ..... A63B 55/04

[52] U.S. Cl. ..... 248/97; 248/99

[58] Field of Search ..... 248/95, 97, 98, 99, 248/100, DIG. 12; 220/1 T, 403, 404

[56] References Cited

U.S. PATENT DOCUMENTS

| | | | |
|---|---|---|---|
| 1,542,164 | 6/1925 | Nelson | 248/97 |
| 2,470,977 | 5/1949 | Chidsey | 248/97 |
| 4,199,122 | 4/1980 | Christie | 248/97 |
| 4,316,591 | 2/1982 | Muraoka | 248/97 |
| 4,407,474 | 10/1983 | Swenson | 248/97 |
| 4,437,634 | 3/1984 | Hambleton | 248/97 |
| 4,458,867 | 7/1984 | Malik | 248/97 |
| 4,467,989 | 8/1984 | Stroh | 248/97 |
| 4,576,310 | 3/1986 | Isgar | 220/1 T |
| 4,620,683 | 11/1986 | Clayton | 248/97 |
| 4,623,111 | 11/1986 | Prader | 220/404 |
| 4,664,347 | 5/1987 | Brown | 220/404 |
| 4,697,771 | 10/1987 | Majors | 248/97 |
| 4,735,340 | 4/1988 | Preston | 220/1 T |

FOREIGN PATENT DOCUMENTS

| | | | |
|---|---|---|---|
| 631727 | 8/1963 | Belgium | 248/99 |
| 1524905 | 9/1978 | United Kingdom | 248/99 |

*Primary Examiner*—J. Franklin Foss
*Assistant Examiner*—Robert A. Olson
*Attorney, Agent, or Firm*—Henderson & Sturm

[57] ABSTRACT

A support rack (10) for twin handled plastic bags (100) wherein the support rack (10) comprises a support framework unit (11) and a handle capturing unit (12); wherein, the handle capturing unit (12) comprises a pair of stepped handle capturing members (20) whereby the effective width of the openings of the plastic bag (100) may be determined by the selective placement of the handles (101) of the plastic bag (100) relative to the stepped handle capturing members (20).

1 Claim, 1 Drawing Sheet

FIG. 1.
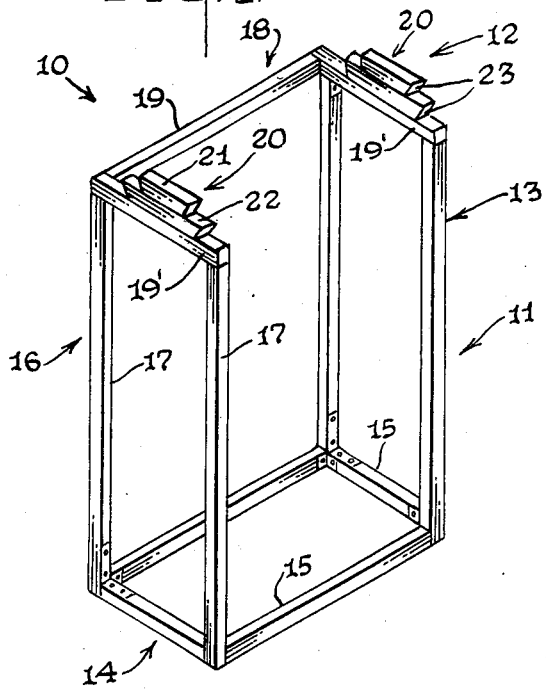
FIG. 2.
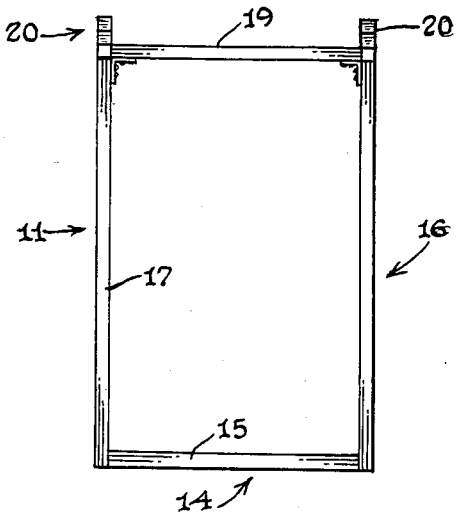
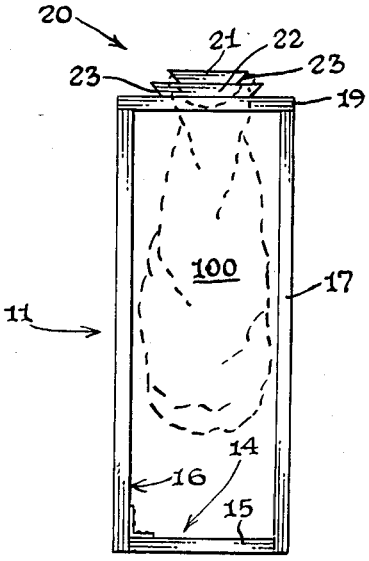
FIG. 3.
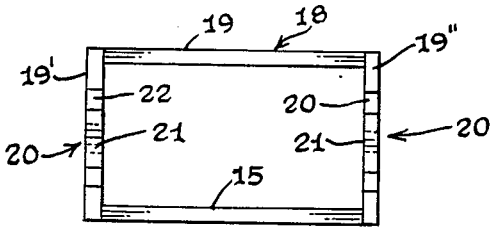
FIG. 4.
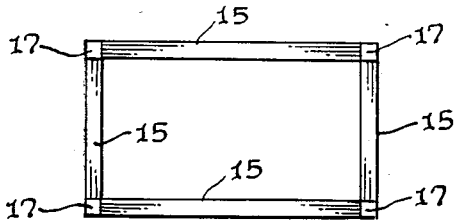
FIG. 5.

SUPPORT RACK FOR PLASTIC BAGS

TECHNICAL FIELD

The present invention relates to specialized support devices in general and more particularly to a support rack for plastic bags.

BACKGROUND OF THE INVENTION

This invention was the subject matter of DDP Registration No. 180487 filed in the U.S. Patent and Trademark Office on Nov. 6, 1987.

As anyone who has shopped recently in a supermarket is aware, the use of thin twin handled plastic bags for transporting groceries has become so widespread that the traditional paper bag grocery sack is fast on its way to becoming obsolete.

As a consequence of the foregoing situation the prior art is replete with myriad and diverse support rack constructions for plastic bags; examples of which can be seen by reference to the following U.S. Pat. Nos: 4,407,474; 4,316,591; 4,437,634; and, 4,697,771.

While all of the aforementioned prior art constructions are adequate for the basic purpose and function for which they have been specifically designed, these prior art devices are also deficient in a number of salient respects in that: all of the known prior art support racks employ at least three solid wall surfaces including the base, and none of the prior art constructions provide a means for varying the mouth opening of the plastic bag that is to be suspended therefrom.

As a result there has existed a longfelt need among those individuals involved with the development and use of this type of a support structure for an improved support rack configuration that will overcome the stated deficiencies of the prior art constructions.

BRIEF SUMMARY OF THE INVENTION

Briefly stated, the support rack apparatus for plastic bags that forms the basis of the present invention comprises in general: a support framework unit and a selectable width handle capturing unit.

The support framework unit comprises in general: an open generally rectangular framework member having a generally C-shaped top portion wherein the handle capturing unit is disposed on the opposed arms of the top portion of the framework unit.

The selectable width handle capturing unit in turn comprises a pair of stepped shoulder handle capturing members; wherein, each handle capturing member includes a plurality of generally rectangular step elements stacked upon one another and provided with inwardly angled sides; wherein, complimentary opposed step elements will not only support the plastic bags, but will also spread the individual bag handles apart a given width to vary the effective width of the mouth of the bag to facilitate the insertion of articles into the bag interior.

BRIEF DESCRIPTION OF THE DRAWINGS

These and other objects, advantages, and novel features of the invention will become apparent from the detailed description of the best mode for carrying out the preferred embodiment of this invention which follows; particularly when considered in conjunction with the accompanyig drawings, wherein:

FIG. 1 is a perspective view of the support rack of this invention;

FIG. 2 is a front plan view;

FIG. 3 is a side plan view;

FIG. 4 is a top plan view; and,

FIG. 5 is a bottom plan view.

BEST MODE FOR CARRYING OUT THE INVENTION

As can be seen by reference to the drawings and in particular to FIG. 1, the support rack for plastic bags that forms the basis of the present invention is designated generally by the reference numberal (10). The support rack (10) comprises in general: a support framework unit (11) and a handle capturing unit (12). These units will now be described in seriatim fashion.

As shown in FIGS. 1 thru 5, the support framework unit (11) comprises an open generally rectangular framework member (13). The framework member (13) includes a base portion (14) comprising four horizontally disposed base frame elements (15); vertical side portions (16) comprising four vertically disposed side frame elements (17) operatively secured at the corners of the base frame elements (15); and, a top portion (18) comprising three horizontally disposed top frame elements (19) operatively secured to the tops of the side frame elements (17) and connected to one another to produce a generally C-shaped configuration.

As can best be seen by reference to FIGS. 1 thru 4, the handle capturing unit (12) comprises a pair of stepped handle capturing members (20) disposed on the opposed arms (19') (19'') of the generally C-shaped top portion (18) of the framework unit (11).

In addition, each of the stepped handle capturing members (20) comprises a plurality of trapezoidal step elements (21) (22) stacked one upon the other and having inwardly angled sides (23) whose purpose and function will be described shortly. Furthermore, the effective length of the trapezoidal step elements (21)(22) diminishes in accordance with the relative distance of the step element (21)(22) from the top of the framework unit (11).

Prior to describing the operation of the support rack (10) it should be remembered that this structure was specifically designed to be used in combination with the well recognized twin handled plastic bag construction (100) that is finding widespread current usage around the country. Turning now particularly to FIG. 3, it can be appreciated that the effective width of the bag opening will depend upon which pair of the opposed step elements (21)(22) that the handles (101) of the bag (100) are looped over in accordance with the wishes of the user of the support rack (10).

In instances wherein a relatively wide bag mouth opening is desired, the handles (101) would be looped over the relatively longer one (22) of the step elements (21)(22); and, in instances wherein a narrower bag mouth opening is desired the handles (101) would be looped over the shorter one (21) of the step elements (21)(22).

Having thereby described the subject matter of this invention it should be apparent that many substitutions, modifications, and variations of the support rack (10) are possible in light of the above teachings. It is therefore to be understood that the invention as taught and described herein is only to be limited to the extent of the breadth and scope of the appended claims.

I claim:

1. A support rack adapted to suspend and support twin handled plastic bags so as to selectively choose the effective width of the mouth of the plastic bag; wherein, the support rack consists of:

a support framework unit comprising an open generally rectangular framework member including a base portion, vertical side portions and a top portion; and, a handle capturing unit comprising a pair of stepped handle capturing members disposed on opposed sides of the top portion of said framework unit;

wherein, each of the pair of stepped handle capturing members comprises:

a plurality of trapezoidally configured step elements stacked one upon the other wherein the effective length of each of the plurality of step elements diminishes in accordance with the relative distance of the step element from the top portion of said framework unit; and, wherein the top portion of said framework element has a generally C-shaped configuration and the handle capturing members are disposed on the opposed arms of the generally C-shaped top portion.

* * * * *